United States Patent [19]
Trainer

[11] 4,290,410
[45] Sep. 22, 1981

[54] COAL STOVE

[76] Inventor: Lawrence E. Trainer, Box 205, Bryantville, Mass. 02327

[21] Appl. No.: 15,446

[22] Filed: Feb. 26, 1979

[51] Int. Cl.³ ..... F23M 5/00
[52] U.S. Cl. ..... 126/146; 126/144
[58] Field of Search ..... 126/58, 285 A, 290, 126/144, 146

[56] References Cited

U.S. PATENT DOCUMENTS

| | | | |
|---|---|---|---|
| 21,446 | 9/1858 | Savage | 126/58 |
| 110,274 | 12/1870 | Old | 126/58 |
| 1,202,440 | 10/1916 | Sheeley | 126/58 |
| 1,648,622 | 11/1927 | Ridgley | 126/146 |
| 2,217,059 | 10/1940 | Klute | 126/146 |

*Primary Examiner*—Sheldon J. Richter
*Assistant Examiner*—Wesley S. Ratliff, Jr.
*Attorney, Agent, or Firm*—Wolf, Greenfield & Sacks

[57] ABSTRACT

A steel-bodied, coal burning stove is provided with an improved combustion system including a one-piece fire pot having an integral, non-shakeable grate. The pot is mounted in the lower regions of the stove and is suspended by a circular mounting ring arrangement which defines the interior of the stove into upper and lower chambers. The pot projects downwardly from the mounting ring arrangement into the lower of the stove chambers. The mounting ring arrangement is constructed to enable air to flow directly from the lower chamber, peripherally about the pot to the upper chamber, bypassing the grate and means are provided to vary the flow of such bypass air.

13 Claims, 2 Drawing Figures

COAL STOVE

BACKGROUND AND SUMMARY OF THE INVENTION

This invention relates to improvements in coal burning stoves intended for use in space heating applications. Although coal stoves have not been in wide use for many decades, recent difficulties in supply and costs of other fuels, such as oil and gas, has caused a renewed interest in space heating stoves. The present invention relates to improvements in coal-burning stoves which are intended to overcome a number of problems and disadvantages encountered with prior coal burning stoves. For example, one of the objectionable features of coal-burning stoves is that they tend to generate unpleasant fumes and gases particularly when starting a fresh fire or when adding coal to an already existing fire. It is believed that these fumes are the result of incomplete combustion which typically occurs before the fire has become hot enough to cause complete combustion. Typically, the noxious gases will be generated for fiteen to twenty minutes, during which time they may permeate the living space in which the stove is contained.

Another difficulty presented with prior coal stoves is that they often do not burn coals completely. Frequently, nuggets or "klinkers" are left with the ashes, indicating incomplete combustion and wasted fuel. It is believed that this is in large measure the result of the design of the grate and fire pot of the stove as well as the manner in which it is mounted within the stove and the geometric relationship between these internal elements of the stove. Also among the features of prior coal stoves which are believed to have presented difficulties is that the grates were moveably mounted so that they could be shaken to permit ashes to fall through the holes in the grates. While this was intended to provide for better air flow through the coals, it is believed that it would cause klinkers to become stuck in the grates which would tend to block the grates and impede proper air flow through the coals rather than assist it. It is among the general objects of the present invention to provide an improved coal stove which minimizes the foregoing and other difficulties encountered with prior coal stoves.

In brief, my stove includes a generally cylindrical body which may be formed from steel. An integral, one-piece fire pot which receives the coal has grate openings formed in its bottom wall. The pot is suspended at the lower region of the stove by a ring-like support secured to the inner periphery of the stove body. The pot is suspended from its upper circumferential lip and cooperates with the supporting ring to separate the interior of the stove into an upper chamber and a lower chamber. The fire pot projects downwardly into the lower chamber and its sidewalls are spaced from the surrounding stove wall to define an annular region at the upper portion of the lower chamber. The bottom wall of the fire pot is provided with a plurality of apertures to define a grate and to permit air to flow into the fire pot upwardly, through its bottom. The sidewalls of the fire pot, which cooperate to define the annular space, are imperforate. During normal combustion, air will enter the lower chamber through an appropriate door in the stove and will flow upwardly through the grate to continually furnish oxygen to the coals and to assure that the coals will burn properly, from the bottom up.

In order to better control the start of combustion and to assure complete combustion at the end of the load of coals, the pot supporting ring is provided with a plurality of apertures which surround the periphery of the pot and can be controlled to vary the cross-sectional flow area of the apertures, thereby enabling a controlled volume of air to flow directly from the lower chamber to the upper chamber, peripherally about and bypassing the fire pot. As will be described in further detail, the fire pot and bypass apertures are constructed and arranged so that they may be operated in a manner which overcomes the above-noted and other difficulties inherent in prior coal stoves.

It is among the general objects of the invention to provide an improved coal burning stove adapted for use in space heating applications.

A further object of the invention is to provide a coal-burning stove in which air can be circulated rapidly through the stove to continually and rapidly purge interior of the stove and minimize chance of noxious fumes leaking into the room.

Another object of the invention is to provide a coal-burning stove having an improved fire pot and grate construction and means for supporting the fire pot and grate which enhances complete combustion.

A further object of the invention is to provide a steel-bodied, coal-burning stove which does not require the use of insulating refractory materials along the interior of the stove.

Another object of the invention is to provide a coal-burning stove of generally higher efficiency yet which is of simplified and economical construction.

DESCRIPTION OF THE DRAWINGS

The foregoing and other objects and advantages of the invention will be appreciated more fully from the following further description thereof, with reference to the accompanying drawings wherein.

DESCRIPTION OF A PREFERRED EMBODIMENT

Figure 1:
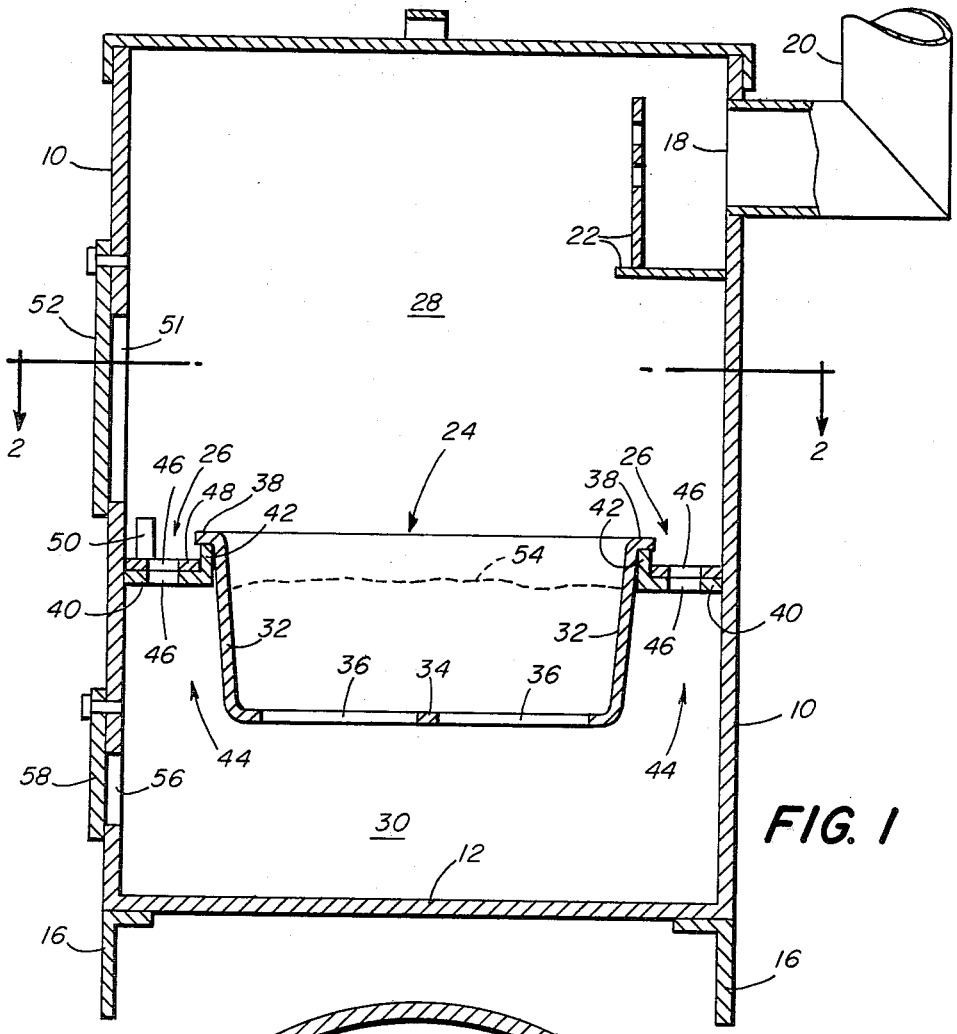
FIG. 1 is a diagrammatic side elevation, in section, of the coal-burning stove.
Figure 2:
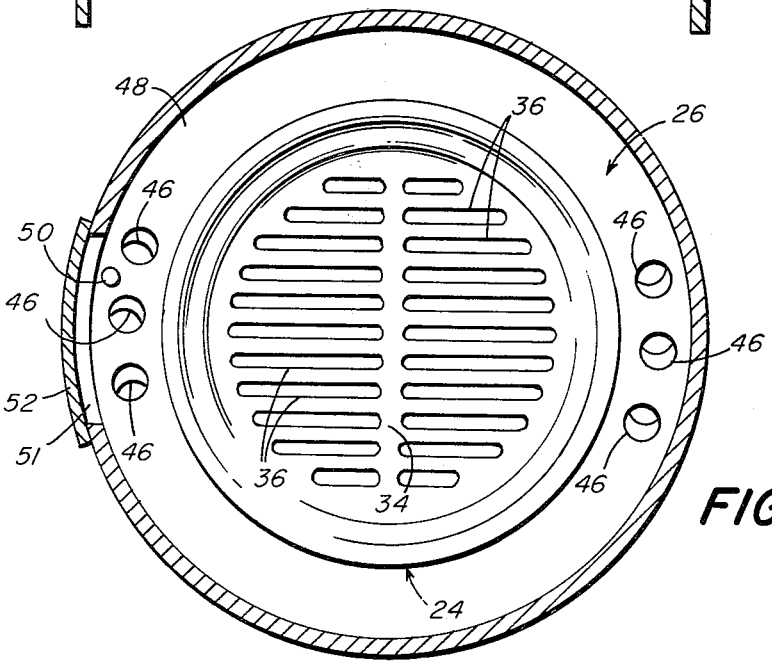
FIG. 2 is a somewhat diagrammatic sectional plan view of the stove as seen along the line 2—2 of FIG. 1.

As shown in the drawings, the stove preferably has a cylindrical main body 10 which, preferably, is formed from steel, as is the bottom wall 12. If desired, the stove may be provided with various cast iron ornaments although it should be understood that it is not necessary to use cast iron in the construction of my stove. The upper end of the stove is provided with a cover 14 which may be removable or hingedly mounted to the cylindrical body 10 to provide access to the interior of the stove. The stove also includes supporting members such as an appropriate stand or feet, indicated generally at 16 in FIG. 1. The upper end of the stove is provided with a flue opening 18 which is connected to an appropriate flue 20. A flue baffle 22 preferably is secured to the interior of the body 10 in spaced, but somewhat obstructing relation to the flue opening 18 to limit the draft of the stove so that the body of the stove may become heated by the hot air and combustion products within the stove.

A fire pot, indicated generally at 24, receives the coal and is supported within the main body of the stove by a circular support ring arrangement indicated generally at 26. The support arrangement 26 defines the stove into an upper chamber 28 and a lower chamber 30. The fire pot 24 preferably is formed from cast iron in a single, unitary piece. The pot has a continuous, imperforate sidewall 32 and a flat bottom wall 34 which has a plurality of openings 36, preferably elongate, as shown, which define the grate. The upper end of the sidewall 32 terminates in an outwardly extending continuous rim 38 by which the pot is suspended from the support arrangement 26.

The support arrangement 26 includes a flat annular plate 40 which is secured to the inner surface of the stove body 10, as by welding. The inner edge of the lower plate 40 is secured to a circular, ring-like mounting flange 42 which has a portion extending upwardly from the flat annular plate 40. The supporting arrangement 26 of the flat annular plate 40 and circular flange 42 is arranged to receive the coal pot 24 and to support the coal pot by its rim 38 which rests on the upper edge of the flange 42. For reasons discussed further below, the support arrangement and pot 24 are arranged so that the pot 24 may project downwardly into the lower chamber 30 and in a manner in which the sidewalls 32 of the coal pot 24 are spaced from the inner surface of the stove body 10. Thus, the upper region of the lower chamber 30 is in the form of an annular space 44 defined by the main body 10, the support arrangement 26 and the sidewall 32 of the coal pot 24. The annular space 44 serves a number of purposes described more fully herein. The air within the annular space 44 will become quite hot because it is in direct contact with the imperforate sidewall 32 of the fire pot. This heated annular region of air causes the lower region of the stove body to become heated which assures that all surfaces of the body of the stove will be hot and thereby be better able to heat the living space in which the space is contained. In addition, the direct heating of the air within the annular space results in increased air flow during purging and at the end of a burning cycle, as described more fully herein. The spacing of the sidewalls 32 of the pot from the main body 10 of the stove also omits the necessity for lining the inner surface of the stove with a refractory material such as fire brick because the air space within the annular region is sufficient to prevent the coals from heating the main body 10 of the stove to a temperature which might burn or warp the steel.

As mentioned, the stove includes a means by which air may flow directly from the lower chamber 30 into the upper chamber 28, bypassing the coal pot 24. To this end, the flat lower plate 40 of the support arrangement 26 is provided with a plurality of circumferentially spaced apertures 46A. The apertures 46A may be fully open, fully closed, or partly open by means of a control ring 48 which rests slideably on the circular plate 40. The control ring 48 is provided with a corresponding plurality of circumferentially spaced apertures 46B which are registerable with the apertures 46A in the plate 40. The apertures preferably are arranged symmetrically and peripherally about the coal pot 24, as shown. The relative position of the control ring 48 may be adjusted by means of a post 50 which is secured to and extends upwardly from the ring. The post is accessible through the coal loading opening 51 in the sidewall 10 of the stove. the opening 51 is normally closed by a door 52 which may be opened to expose the interior of the upper chamber 28 to load coal in the pot 24 and also to provide access to the pin 50. The control ring 48 may be rotated by simply tapping the pin 50 lightly with appropriate stove tool, such as a stoker or shovel, to urge the ring either clockwise or counterclockwise as desired.

From the foregoing it will be appreciated that the fire pot 24 and its integral gate will remain stationary at all times during operation of the stove. Operation of the control ring 48 does not interfere with or cause any movement of the grate and will not tend to shake the ashes or coal within the fire pot 24.

In operation, a paper or wood starting fire is initiated in the fire pot 24, access to the pot 24 being provided through the opening 51. A small quantity of coal then is loaded into the coal pot 24 and after it begins to burn, the remaining load of coal is placed in the fire pot, for example, to the level indicated at 54. Access to the lower chamber 30 is provided through an air inlet opening 56 formed in the lower portion of the body 10 of the stove. A hinged or otherwise movable door 58 is provided to cover the air inlet 56 to control the draft through the stove during operation. When the fire is initially started, the control ring 48 is oriented to block air flow through the apertures 46A in the support arrangement 26. After the coals have ignited and the fire is underway, the ring 48 is rotated to open the peripheral holes 46A and to permit some of the air to flow from the lower chamber 30, peripherally about the pot and into the upper chamber 28, bypassing the fire pot. It may be desirable to maintain the air inlet 56 fully open at this time so that there will be sufficient air flow to continue the combustion as well as to permit air to bypass the coal pot 24. It should be noted that it is during this early start-up time of the fire that the above-mentioned noxious gases and fumes are produced. By opening the peripheral holes 46 an increased air flow is permitted through the stove which tends to accelerate rapid purging of the gases in the stove outwardly through the flue. Thus, the undesirable products of combustion are exhausted rapidly through the stove and do not have sufficient time to escape from the stove into the room. In addition, the increased air flow through the stove accelerates the combustion process and causes the coal to reach its hottest temperature as early as possible. I have found that after approximately five to ten minutes, the coal is hot enough so that combustion is substantially complete and there are no more undesirable fumes. The control ring 48 then may be returned to its original closed configuration and the damper door 58 can be adjusted to provide the optimum air flow through the burning coals.

It should be noted that the manner in which the coal pot 24 is mounted contributes to the rapid purge of gases through the stove to assure minimal migration of fumes into the surrounding room. As mentioned above, the sidewall 32 of the pot extends downwardly into the lower chamber 30 and defines the annular space 44. Thus, air in the annular space 44 is in direct contact with the hot sidewalls 32 and will be very hot which will tend to accelerate air flow through the apertures 46A. In addition, the preheated air also will tend to rise more rapidly through the upper chamber 28 and out the flue 20.

With the damper door 58 suitably adjusted, the fire will continue to burn. Among the features of the present invention, is that the fire pot and its integral grate remain stationary at all times and there is no means for shaking the grate. Instead, the present invention simply permits ash to fall downwardly through the grate openings 36 to the bottom of the stove without any external assistance. A removable ashtray (not shown) may be provided on the bottom wall 12 of the stove to facilitate later cleaning, if desired. I have found that better and more complete burning of the coals is achieved by utilizing the foregoing, non-shakeable fire pot construction and omitting any shaker mechanism. While shaking the ashes from the grate will remove some obstruction to air flow from the ashes, the net obstruction to air flow can be increased from shaking. This results from the fact that shaking not only dislodges some of the ashes, but also dislodges some of the partly burned coals which tend to become stuck in the grate openings. The partly burned coals obstruct air flow and provide a bed which further tends to prevent ashes from falling through the grate. As a result, the remaining coals will burn less completely than if there had been no shaking at all.

The present invention provides for more efficient and complete combustion in other respects. In this regard, it should be noted that coal burns from the bottom of the pile in an upward direction. It is desirable that the flow of air through the coal is in a bottom-up direction. The construction of my stove assures that air will flow to and through the coals substantially only in an upward direction as is desired. The sidewalls 32 of the pot are imperforate so that air can only flow to and through the coals through the openings 36 in the grate, in an upward direction and in a manner which will promote proper and regular burning of the coal from the bottom up.

As the burning of the coal progresses upwardly through the coal mass, the air flow through the unfallen ash necessarily will be somewhat restricted with the result that some of the unburned coal at the top of the pile may be starved for air necessary for combustion. At this time, the control ring 48 may be rotated to open slightly the peripheral air passages 46A to permit fresh air to flow into the upper chamber 28 and continue to support combustion for the remaining coals at the top of the pile. As a result, practially all of the coals, including the top layers, will be burned completely with a minimum number of unburned klinkers.

Should it be necessary to refuel the stove with an additional load of coal, the coal is dumped into the coal pot 24 on top of the remaining live coals which still are in the pot. The control ring 48 should be operated to open the apertures 46A to maintain rapid purging of the interior of this stove until the fire has reached a sufficient temperature at which the undesirable fumes of incomplete combustion no longer are generated. Thereafter, the stove is operated as described above.

From the foregoing it will be appreciated that I have described an improved coal stove which minimizes the chances of noxious fumes entering the room and which also provides for fuller and more complete combustion of all of the coal in the load, with a minimal number of unburned klinkers. Moreover, the stove is of simple construction and may be made from steel, but does not require a massive lining of refractory material. It should be understood, however, that the foregoing description is intended merely to be illustrative of the invention and that other modifications and embodiments may be apparent to those skilled in the art without departing from the spirit of the invention.

Having thus described the invention, what I desire to claim and secure by Letters Patent is:

1. A coal stove comprising:

a heat conductive stove body having a stove sidewall, a bottom wall and a cover;

a fire pot adapted to receive a load of coal, the fire pot having an apertured bottom wall defining a grate and a sidewall extending upwardly from the bottom wall;

means for supporting the fire pot within the lower region of the stove;

said fire pot and said supporting means being constructed and arranged so that the sidewall of the fire pot is spaced from the sidewall of the stove body thereby defining an annular space between the sidewall of the fire pot and the stove sidewall;

an annular member extending between the stove sidewall and the upper end of the sidewall of the fire pot, the region of the stove above the annular member defining an upper chamber and the region of the stove below the annular member defining a lower chamber;

aperture means formed in the annular member for communication between the annular space and the upper chamber;

means for controlling the flow of air through the aperture means to enable air to flow from the annular space, upwardly into the upper chamber and at a variable, controllable flow rate;

an air inlet formed in the lower region of the stove sidewall in communication with the lower chamber; and a flue outlet formed in the upper region of the stove sidewall in communication with the upper chamber.

2. A coal stove as defined in claim 1 further comprising:

said fire pot supporting means comprising said annular member, said annular member being secured to the interior of the stove body and extending along and inwardly from the sidewall of the stove body;

said pot supporting means being constructed and arranged to engage and support the fire pot by the upper end of the sidewall of the fire pot with the fire pot extending downwardly into the lower chamber.

3. A coal stove as defined in claim 2 further comprising:

the sidewall of the fire pot being imperforate.

4. A coal stove as defined in claim 2 wherein the pot has a radially and outwardly extending rim at the upper edge of the sidewall and wherein pot support means further comprises:

a flat annular plate secured to the inner surface of the stove body;

a circular flange secured to the inner edge of the flat annular plate and extending upwardly therefrom, the upper edge of the flange providing a support for the rim of the fire pot;

a plurality of circumferentially spaced apertures formed in the flat annular plate; and a control ring rotatably and slideably mounted on the annular plate and having apertures formed therein, the apertures in the control ring being cooperative with the apertures in the annular plate to vary the flow area to an extent dependent on the registry of the apertures in the plates, the control ring being operable independently and without requiring movement of the fire pot.

5. A coal stove as defined in claim 4 wherein the main body of the coal stove is formed from steel and wherein the fire pot is formed from cast iron in a single, integral piece.

6. A coal stove as defined in claim 5 wherein the stove is free of refractory lining materials.

7. A coal stove as defined in claim 1 further comprising:

the body of said stove being formed from steel, said stove requiring no refractory lining materials.

8. A coal stove comprising:

a heat conductive stove body having a stove sidewall, a bottom wall and a cover;

a fire pot adapted to receive a load of coal, the fire pot having an apertured bottom wall and a sidewall extending upwardly from the bottom wall;

fire pot supporting means secured to the interior of the stove body and extending along and inwardly from the sidewall of the stove body, the region within the stove above the pot supporting means defining an upper chamber and the region below the fire pot supporting means defining a lower chamber;

said pot supporting means being constructed and arranged to engage and support the fire pot by the upper end of the sidewall of the fire pot with the fire pot extending downwardly into the lower chamber and with the sidewall of the fire pot being spaced from the interior of the sidewall of the stove, thereby defining an annular space between the fire pot and the stove sidewall;

air inlet formed in the lower region of the stove sidewall in communication with the lower chamber;

a flue outlet formed in the upper region of the stove sidewall in communication with the upper chamber; and said pot supporting means including aperture means to enable air to flow from the annular space, peripherally about the sidewall of the fire pot and upwardly into the upper chamber, thereby bypassing the interior of the fire pot.

9. A coal stove as defined in claim 6 wherein the sidewall of the fire pot is imperforate.

10. A coal stove as defined in claim 6 further comprising:

means for controlling the extent to which the aperture means permits air to flow through the lower chamber to the upper chamber.

11. In a coal stove, the improvement comprising, in combination a cylindrical, steel stove body;

a fire pot adapted to receive a load of coal, the fire pot having an apertured bottom wall defining a grate and a cylindrical sidewall extending upwardly from the bottom wall;

means for supporting the fire pot within the stove;

the diameter of the sidewall of the fire pot being less than the internal diameter of the cylindrical stove body thereby defining an annular space between the fire pot sidewall and the stove body;

air flow control means disposed at the upper portion of the annular space for controlling the rate of air flow from the annular space into the upper region of the stove body.

12. A stove as defined in claim 11 further comprising:

said fire pot being formed from cast iron, said stove being free of refractory materials.

13. In a coal stove as defined in claim 11 further comprising, in combination:

said fire pot being formed in a single piece of unitary cast iron having imperforate side walls.

* * * * *